United States Patent [19]

Serveau et al.

[11] Patent Number: 4,910,502

[45] Date of Patent: Mar. 20, 1990

[54] DEVICE FOR DETECTING THE UNBALANCE OF A ROTATING MACHINE FROM A PREDETERMINED THRESHOLD

[75] Inventors: Michel Serveau, Le Pecq; Jean-Louis Fondin, Saint-Nazaire; Alain Dreno, Saint Lyphard, all of France

[73] Assignee: Société Jouan, Saint-Nazaire, France

[21] Appl. No.: 259,172

[22] Filed: Oct. 18, 1988

[30] Foreign Application Priority Data

Oct. 22, 1987 [FR] France ..... 87 14612

[51] Int. Cl.[4] ..... H01N 35/14

[52] U.S. Cl. ..... 340/683; 200/61.51; 200/61.62; 68/23.2; 210/144

[58] Field of Search ..... 73/66, 460, 462; 68/23.2; 210/144; 494/82; 340/683; 200/61.51, 61.62

[56] References Cited

U.S. PATENT DOCUMENTS

| | | | |
|---|---|---|---|
| 2,081,604 | 5/1937 | Schaum | 210/144 |
| 2,807,950 | 10/1957 | Gerhardt et al. | 68/23.2 |
| 3,209,561 | 10/1965 | Burdett | 210/144 |
| 3,227,835 | 1/1966 | Conrath | 210/144 |
| 3,790,727 | 2/1974 | Laserson et al. | 200/61.51 |
| 4,455,461 | 6/1984 | Maguire | 200/61.51 |

*Primary Examiner*—John Chapman
*Assistant Examiner*—Michele Simons
*Attorney, Agent, or Firm*—Scully, Scott, Murphy & Presser

[57] ABSTRACT

A device for detecting the unbalance of a rotating machine from a predetermined threshold. This device includes a pendulum formed from a vertical rod made of an elastically deformable metal, the upper end of which is embedded in an insulating support fixed rigidly to the housing of the rotating machine and which at its lower end carries a metallic mass, the mass being received concentrically, with a predetermined peripheral play, within a metal rink likewise fixed to the housing and insulated electrically from the housing, the ring and the embedded end of the pendulum being connected electrically to an electrical alarm or safety circuit which closes as soon as the mass comes in contact with the ring, where the resonance frequency of the pendulum is below that of the parts of the rotating machine which is subjected to the unbalanced condition.

2 Claims, 2 Drawing Sheets

DEVICE FOR DETECTING THE UNBALANCE OF A ROTATING MACHINE FROM A PREDETERMINED THRESHOLD

The present invention relates to a device for detecting the unbalance in rotating machines, especially in centrifuges, from a threshold considered to be detrimental to the safety of personnel or to the length of life of the machine.

It is stated specifically at once that the object of the invention is not to determine the value of the unbalance nor, above all, the location of the unbalance on the rotating members of the rotating machine, in order to take action to correct it, as balancing machines can do. The sole object if the invention is to detect an unbalance threshold which would be detrimental to the machine and to stop the functioning of the latter before this threshold has been reached, this detection having to be carried out at the least possible cost. The device which it is proposed to produce shall therefore be simple and cheap and consequently of a technological level below the detection devices which could be produced with magnetic sensors, accelerometers or optoelectronic means.

At the present time, there are two known types of device making it psssible to detect an unbalance of a rotating assembly, especially a centriuuge, at very low cost. These devices are illustrated highly diagrammatically in the accompanying FIGS. 1 and 2.

Figure 1:
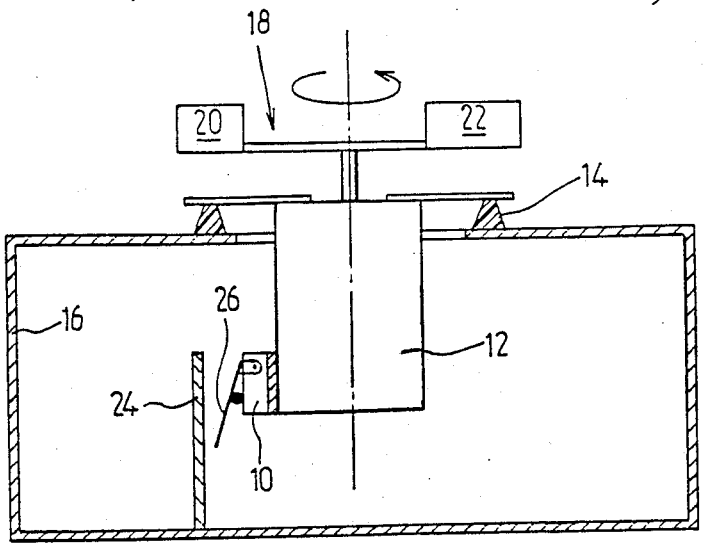
FIG. 1 (PRIOR ART)

The detection device of FIG. 1 comprises a microswitch 10 fastened to the housing 12 of a rotating machine which, by means of an elastic suspension 14 ensuring good damping, rests on a rigid frame 16 considered therefore as not being subjected to the unbalance. The unbalance existing in the rotating assembly 18 of the machine is represented diagrammatically by two weights 20, 22 of slightly different masses, which are fastened to the ends of two radial arms fixed to the shaft of the motor and arranged in the extension of one another. During the rotation of the rotating assembly, the housing of the machine is subjected to an unbalance, and this results in vibrations of the housing in the horizontal plane. To detect this unbalance, there is a stationary stop 24 which is fixed to the frame 16 and which, when the motor is at rest, is at a predetermined distance from the blade 26 of the microswitch. As soon as the component of the unbalance in the direction of the stop 24 becomes equal to the said distance, the microswitch is locked and the functioning of the machine is interrupted.

However, such a device has several serious disadvantages:

first of all, the microswitch is sensitive only in one axis; it therefore does not take into account the transverse components of movement which are always present during the increasing speed;

because of the spread of production tolerances, each microswitch has to be set in position at the factory, until triggering occurs at the value corresponding to the desired detection threshold;

whenever an unbalance is detected, the blade of the microswitch is subjected to mechanical forces which cause successive deformations of the blade and which require frequent adjustments of the microswitch and sometimes even its replacement;

after a certain period of use, the suspensions of the machine deteriorate and change the relative positions between the frame and the microswitch;

detection depends on the horizontal setting of the machine. If the horizontality of the machine varies for any reason whatever, a new adjustment of the microswitch has to be carried out.

The second known detection system is based on the inertia principle. As shown in FIG. 22, it comprises a bulb 28 partially filled with an electrically conductive liquid 30 and having a high inertia. For this purpose, the bulb has a small volume, and a liquid having a high density, for example mercury, will be selected. The bulb is fastened integrally to the housing 12 of the rotating machine. Its upper wall has passing through it two elecrodes 32 which are not in contact with the mercury when the machine is at rest. During the movements of the housing, if the unbalance reaches a certain threshold, the mercury makes contact between the two electrodes and thus closes an electrical circuit which triggers an alarm or the stopping of the machine.

This detection device no longer has some of the deficiencies mentioned with regard to the preceding device. In fact, detection does not depend on the relative position between the housing of the machine and the stationary frame. There is no need to carry out any mechanical adjustment. Contrary to the preceding device, this device has low sensitivity to aging. Moreover, detection is independent of horizontality.

However, it still has numerous defects:

thus, detection take place only in the vertical axis. Now as explained above, the rotating assembly, by virtue of its construction, generates an unbalance having components of movement equally in two horizontal axes perpendicular to one another. The mercury bulb is incapable of detecting the unbalance components in the said horizontal axes;

it is shown that the detection condition depends on the mass of the mercury and on the distance between the surface of the mercury and the ends of the electrodes. Although the manufacturers can guarantee the accuracy of the mass, the same is not true of the abovementioned distance for which the desired accuracy is of the order of a few tenths of a millimeter. It is difficult to control this distance because it is influenced greatly by the geometry of the bulb;

it may happen that the unbalance is acceptable, but despite this the device detects a disruptive unbalance at a high rotational speed. The reason for this is that, at high speed, the mercury emulsifies and comes in contact with the electrodes.

The Patents FR-A-1,357,002, US-A-3,226,016, DE-A1,953,201, DE-B-1,298,045 and NL-A-7,304,620 illustrate examples of unbalance detection devices of one of the two abovementioned types.

The object of the present invention is to overcome the disadvantages of the prior art, and it therefore provides an unbalance detection device which does not require any adjustment at the factory or by the customer, the detection of which depends very little on horizontality, which is insensitive to aging, which has high reproducibility from one device to another, and finally which makes it possible to detect the unbalance in two horizontal axes.

The detection device according to the invention is defined in that it comprises a pendulum formed from a vertical rod made of an elastically deformable metal, the upper end of which is embedded in an insulating support fixed rigidly to the housing of the rotating machine and which at its lower end carries a metallic mass, the latter being receive concentrically, with a predetermined peripheral play, within a metal ring likewise fixed to the housing and insulated electrically from the latter, the said ring and the said embedded end of the pendulum being connected electrically to an electrical alarm or safety circuit which closes as soon as the mass comes in contact with the ring as a result of the occurrence of an unbalance, of which the horizontal component transmitted to the said mass by the rod is equal to the value of the said peripheral play, the physical characteristics of the said pendulum being selected so that its resonance frequency is below that of the parts of the rotating machine subjected to the unbalance.

Figure 3:
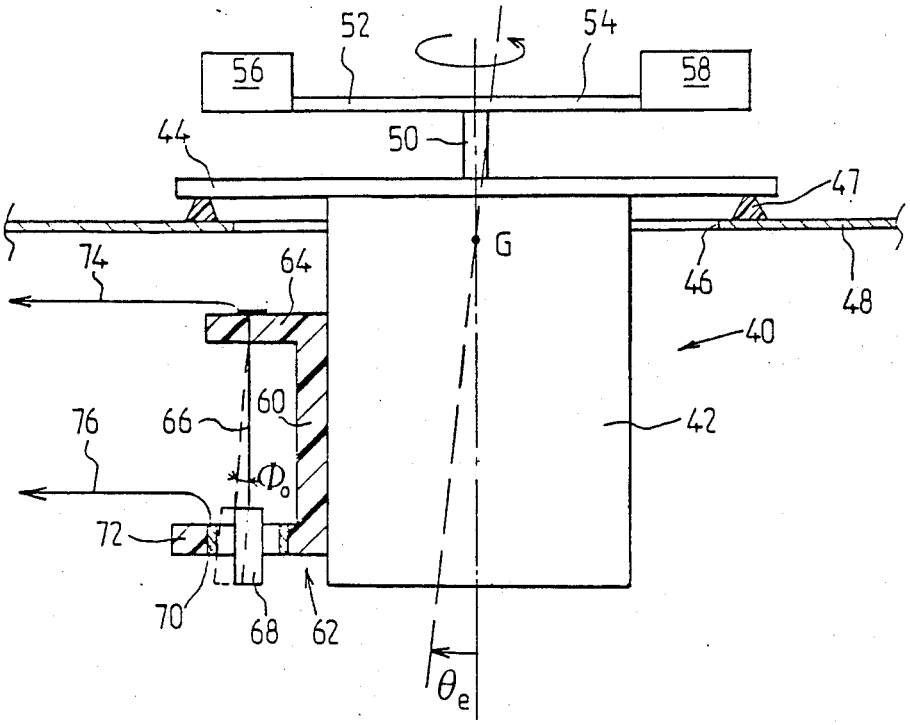
Figure 4:
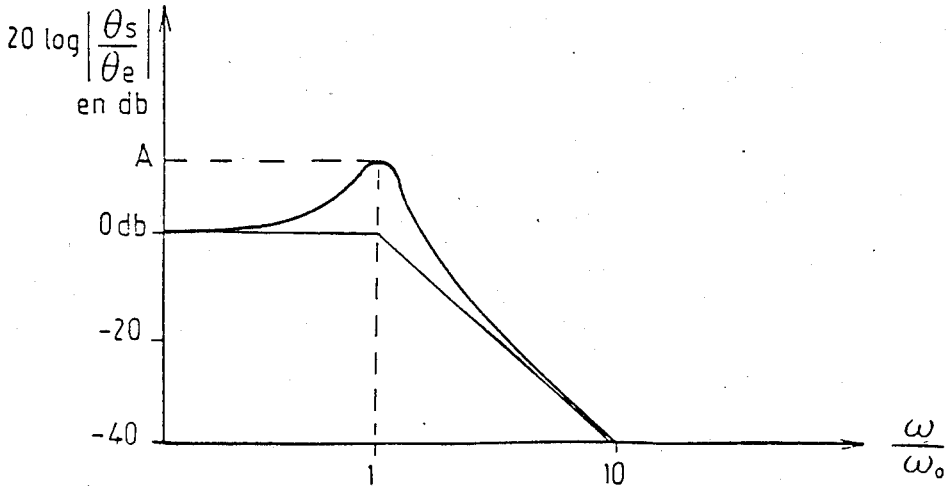

The invention will be understood better from a reading of the description of a particular embodiment made with reference to the accompanying drawings in which:

FIG. 3 shows diagrammatically a detection device according to the invention equipping a rotating machine, and FIG. 4 shows the curve of variation of the reduced amplitude of the elastic pendulum as a function of the reduced vibration frequency.

Figure 2:
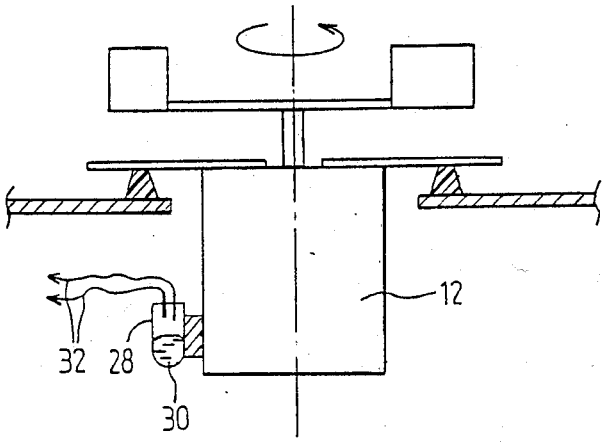
FIG. 2 (PRIOR ART)

Since FIGS. 1 and 2 have already been described previously, we shall pass directly to the description of FIG. 3.

The rotating machine illustrated in this figure is a centrifuge 40, but it goes without saying that this example was chosen only in order to give a clear idea. The centrifuge comprises a housing 42, in which the drive motor is accommodated. It has, in its upper part, an annular flange 44, by means of which it rests on the edge of an orifice 46 made in a horizontal wall of a frame 48 assumed to be fixed rigidly to the ground and therefore not subject to the unbalance. The housing passes through the orifice coaxially with substantial play, so that it is supported by the flange only. An elastic peripheral gasket 47 or several elastic studs distributed uniformly along the periphery of the flange ensure the damping of the vertical component of the vibrations attributable to the unbalance to which the housing is subjected.

The rotating assembly if the centrifuge is represented diagrammatically in the form of a shaft 50 equipped with two radial arms 52, 54 carrying, at their ends, two weights, 56, 58, the masses of which are assumed to differ slightly, the difference in the masses $\Delta m$ being the unbalance.

A U-shaped support 62 made of electrically insulating material is fastened rigidly by means of its central branch 60 to the lateral wall of the housing 42. Embedded in the upper branch 64 of the said support is the upper end of a vertical rod 66 made of an elastically deformable metal, preferably steel. The rod is vertical and, at its lower end, carries a metallic mass 68 which is of cylindrical shape, but which can have any other geometrical shape, for example prismatic or spherical.

The cylindrical mass 68 is received within a metal ring 70 of larger cross section, which is set inside an orifice made through the lower arm 72 of the insulating support. When the rotating assembly is at rest, the cylindrical mass is exactly in the axis of the ring, a constant peripheral play prevailing between it and the ring. This play corresponds to the maximum value $\Phi_o$ which is given to the angle of deflection of the pendulum when it begins to vibrate during the increasing speed of the rotating assembly.

The rod 66 and the ring 70 are connected by means of electrical conductors 74, 76 to an electrical or electronic alarm or safety circuit capable of triggering an alarm or of stopping the functioning of the drive motor of the movable assembly, as soon as the mass touches the ring, that is to say as soon as the vibrations of the pendulum are on the point of exceeding the critical amplitude $\Phi_o$ which has been fixed.

To understand the functioning of the unbalance detection device according to the invention, the physical principle on which it is based will be explained.

The elastic pendulum behaves like a damped mechanical oscillator, the housing being the exciting system and the pendulum being the excited system. It is known that such an oscillator is governed by a differential equation of the second degree, and that its frequency response curve (reduced amplitude as a function of reduced frequency $$\frac{\theta_s}{\theta_e} \; a)$$

has the shape shown in FIG. 4 for a given damping.

$\theta_e$ is the instantaneous excitation angle communicated by the housing (see FIG. 3). This is the angle through which the housing pivots about its center of gravity G under the action of the unbalance;

$\theta_s$ is the angle of deflection of the pendulum under the effect of this excitation;

$\omega_o$ is the natural oscillation frequency of the pendulum, and $\omega$ is the rotational speed of the rotating assembly.

The frequency $\omega_o$ is a constant which depends solely on the following parameters:

the coefficient of elasticity of the steel rod, the length of the steel rod, the value of the suspended mass.

The frequency $\omega_o$ increases with the coefficient of elasticity of the rod, and it decreases with the length of the rod and with the value of the suspended mass.

The damping at a given frequency $\omega_o$ depends only on the ratio between a hydraulic friction term and the coefficient of elasticity of the rod, the said hydraulic coefficient term comprising the friction of the mass of the pendulum in the air and the mechanical losses at the fastening of the pendulum to the insulating support.

It will be seen from FIG. 4 that, for an excitation frequency $\omega$ of the pendulum in the neighborhood of the natural oscillation frequency $\omega_o$ (hence, when $\omega/\omega_o=1$), there is an amplification of the deflection of the mass 68. There is therefore the relation between the modules of $\theta_s$ and $\theta_e$ $$|\theta_s| = A|\theta_e|$$

A being the coefficient of amplification which depends only on the damping parameter.

The curve of FIG. 4 also shows that, when the movable assembly rotates and there is an unbalancing of the rotating masses, it generates an angle of excitation $\theta_e$ of which the modulus $|\theta_e|$ first increases with the rotational speed $\omega$ of this movable assembly (the rising part of the curve) because of the elastic connection between the housing and the rigid frame. The rotating assembly itself behaves like a system of the second degree with a natural oscillation frequency. The amplitudes subsequently decrease when the rotational speed exceeds the value corresponding to the said natural frequency.

The condition at which detection will occur will therefore be $$A\theta_e \geqq \Phi_o \quad (1)$$

$\Phi_o$ being the maximum permissible amplitude for the pendulum, that is to say the angle of deflection of the pendulum when the mass 68 is in contact with the ring 70, and A being the coefficient of amplification obtained by means of the elastic pendulum.

It is shown that the amplitude of excitation $|\theta_e|$ conforms to the equation $$|\theta_e| = \frac{\Delta m\ \omega^2 R}{K} \quad (2)$$

in which $\Delta m$ is the unbalance $\omega$ is the rotational speed of the rotating assembly R is the radius of gyration of the unbalance K is a coefficient which depends on the elasticity of the suspensions and on the geometry of the movable assembly.

If the condition (1) is taken into account, the complete detection condition:

$$\Delta m \geqq \frac{K\Phi_o}{A\omega^2 R} \quad (3)$$

is obtained.

The unbalance detection device according to the invention must be as efficient as possible, to ensure that the detection of the unbalance take place under such conditions that the excitation amplitude $\theta_e$ (t) never reaches values detrimental to the length of life and operating safety of the rotating machine.

The result of the equation (3) is that detection must take place at a very low speed, so that if the unbalance $\Delta m$ exceeds the limiting condition, the suspended mass 68 comes in contact with the ring 70. The electrical circuit, by closing, generates a command to stop the motor and an alarm signal for the operator of the machine.

The device according to the invention requires no adjustment at the factory or by the customer. It is insensitive to aging and makes it possible to carry out a detection which is virtually independent of the horizontality of the rotating machine. Furthermore, it makes it possible to detect an unbalance in two perpendicular horizontal axes.

We claim:

1. A device for detecting the unbalance of a rotating machine from a predetermined threshold, defined in that it comprises a pendulum formed from a vertical rod (66) made of an elastically deformable metal, the upper end of which is embedded in an insulating support (62) fixed rigidly to the housing (42) of the rotating machine and which at its lower end carries a metallic mass (68), the latter being received concentrically, with a predetermined peripheral play, within a metal ring (70) likewise fixed to the housing and insulated electrically from the latter, the said ring and the said embedded end of the pendulum being connected electrically to an electrical alarm or safety circuit which closes as soon as the mass (68) comes in contact with the ring (70) as a result of the occurrence of an unbalance, of which the horizontal component transmitted to the said mass by the rod is equal to the value of the said peripheral play, the physical characteristics of the said pendulum being selected so that its resonance frequency is below that of the parts of the rotating machine which are subjected to the unbalance.

2. The unbalance detection device as claimed in claim 1, wherein the insulating support (62) is U-shaped and is fastened to the housing (42) by means of its central branch (60), its other two branches (64, 72) extending horizontally one above the other, wherein the said elastic rod (66) is embedded at its upper end in the upper horizontal branch (64), and wherein the ring (70) is set inside an orifice concentric relative to the axis of the pendulum and made in the lower horizontal branch (72) of the support.

* * * * *

UNITED STATES PATENT AND TRADEMARK OFFICE

CERTIFICATE OF CORRECTION

PATENT NO. : 4,910,502

DATED : March 20, 1990

INVENTOR(S) : Michel Serveau

It is certified that error appears in the above-identified patent and that said Letters Patent is hereby corrected as shown below:

In the Abstract, line 9: "rink" should read as --ring--

Column 1, line 16: "if" should read as --of--

Column 1, line 28: "psssible" should read as --possible--

Column 1, line 29: "centriuuge" should read as --centrifuge--

Column 2, line 9: "FIGURE 22" should read as --FIGURE 2--

Column 2, line 16: "elecrodes" should read as --electrodes--

Column 2, line 28: "aging" should read as --ageing--

Column 2, line 53: "DE-A1,953,201," should read as --DE-A-1,953,201,--

Column 2, line 61: "aging" should read as --ageing--

Column 3, line 44: "if" should read as --of--

UNITED STATES PATENT AND TRADEMARK OFFICE

CERTIFICATE OF CORRECTION

PATENT NO. : 4,910,502

DATED : March 20, 1990

INVENTOR(S) : Michel Serveau

It is certified that error appears in the above-identified patent and that said Letters Patent is hereby corrected as shown below:

Column 6, line 6: "aging" should read as --ageing--.

Signed and Sealed this

Twenty-third Day of July, 1991

*Attest:*

HARRY F. MANBECK, JR.

*Attesting Officer*

*Commissioner of Patents and Trademarks*